US011618961B2

(12) United States Patent
Akkus et al.

(10) Patent No.: US 11,618,961 B2
(45) Date of Patent: Apr. 4, 2023

(54) ELECTROCHEMICALLY PRODUCED MATERIALS; DEVICES AND METHODS FOR PRODUCTION

(71) Applicant: CASE WESTERN RESERVE UNIVERSITY, Cleveland, OH (US)

(72) Inventors: Ozan Akkus, Cleveland Heights, OH (US); Mousa Younesi, Shaker Heights, OH (US); Umit Levent Erol, Cleveland Heights, OH (US)

(73) Assignee: CASE WESTERN RESERVE UNIVERSITY, Cleveland, OH (US)

( * ) Notice: Subject to any disclaimer, the term of this patent is extended or adjusted under 35 U.S.C. 154(b) by 721 days.

(21) Appl. No.: 16/605,859

(22) PCT Filed: Apr. 20, 2018

(86) PCT No.: PCT/US2018/028549
§ 371 (c)(1),
(2) Date: Oct. 17, 2019

(87) PCT Pub. No.: WO2018/195409
PCT Pub. Date: Oct. 25, 2018

(65) Prior Publication Data

US 2021/0108321 A1 Apr. 15, 2021

Related U.S. Application Data

(60) Provisional application No. 62/487,506, filed on Apr. 20, 2017.

(51) Int. Cl.

| | |
|---|---|
| ***C25D 1/04*** | (2006.01) |
| ***D01D 5/00*** | (2006.01) |
| ***D01D 10/00*** | (2006.01) |

(52) U.S. Cl.
CPC ..... *C25D 1/04* (2013.01); *D01D 5/00* (2013.01); *D01D 10/00* (2013.01)

(58) Field of Classification Search
CPC ..... D01D 5/00; D01D 10/00; D01D 5/0007; D01D 5/0076; D01D 5/0046
See application file for complete search history.

(56) References Cited

U.S. PATENT DOCUMENTS 5,484,061 A 1/1996 Dunn
7,967,588 B2 6/2011 Green et al.
(Continued)

FOREIGN PATENT DOCUMENTS

WO 2013165975 A1 11/2013

OTHER PUBLICATIONS

L. Stappers, et al., Flow Alignment of Prolate Particles on a Rotating Disk Electrode, Journal of The Electrochemical Society, Jan. 1, 2006, pp. C660-C667, vol. 153, No. 9.
(Continued)

*Primary Examiner* — Emmanuel S Luk
(74) *Attorney, Agent, or Firm* — Pearne & Gordon LLP

(57) ABSTRACT

Devices suitable for the production of electrochemically aligned materials such as strands, threads or fibers. The device includes a substantially horizontally aligned electrochemical cell in one embodiment, with the arrangement producing highly compacted materials. Materials including electrochemically aligned and compacted compounds are also disclosed, along with methods for making and using the materials.

20 Claims, 5 Drawing Sheets

(56) References Cited

U.S. PATENT DOCUMENTS

2003/0102585 A1* 6/2003 Poulin ..... D01D 5/06 428/408
2005/0104258 A1* 5/2005 Lennhoff ..... D01D 5/0092 425/382.2
2007/0066201 A1 3/2007 Chen et al.
2009/0091065 A1* 4/2009 Katti ..... D01D 5/0092 425/66
2009/0324950 A1* 12/2009 Kim ..... D01D 7/00 428/400
2010/0148404 A1* 6/2010 Smida ..... D02G 3/36 425/66
2011/0180972 A1* 7/2011 Lee ..... D01D 10/02 264/465
2012/0009292 A1* 1/2012 Mitchell ..... D01D 5/0076 425/174.8 E
2014/0051316 A1 2/2014 Zhang et al.
2014/0331455 A1* 11/2014 Stylios ..... D01G 15/84 425/8
2015/0376806 A1 12/2015 Akkus et al.
2018/0202074 A1* 7/2018 Uchida ..... D01D 5/0061
2019/0338445 A1* 11/2019 Haff ..... D01D 5/0092

OTHER PUBLICATIONS

European Search Report for family member application EP18787858.2 dated Nov. 20, 2020.
Younesi et al., "Fabrication of Compositionally and Topographically Complex Tissue Forms by 3D-Electrochemical Compaction of Collagen," Biofabrication, 7(3): 035001, doi:10.1088/1758-5090/7/3/035001, submitted as Biofabrication, Author manuscript, available in PMC Jun. 12, 2016, pp. 1-21 (2016).
Sun et al., "Electrospun fibers and their application in drug controlled release, biological dressings tissue repair, and enzyme immobilization," RSC Adv., vol. 9, pp. 25712-25729 (2019).

* cited by examiner

ELECTROCHEMICALLY PRODUCED MATERIALS; DEVICES AND METHODS FOR PRODUCTION

STATEMENT REGARDING FEDERALLY SPONSORED RESEARCH OR DEVELOPMENT

This invention was made with government support under Contract DMR-1306665 awarded by the National Science Foundation. The government has certain rights in the invention.

FIELD OF THE INVENTION

The present invention relates to devices suitable for the production of electrochemically aligned materials such as strands, threads or fibers. The device includes a substantially horizontally aligned electrochemical cell in one embodiment, with the arrangement producing highly compacted materials. Materials including electrochemically aligned and compacted compounds are also disclosed, along with methods for making and using the materials.

BACKGROUND OF THE INVENTION

WO 2015/0376806 relates to electrochemically aligned and compacted molecules, nanoparticles and microparticles with ampholytic nature, such as collagen, elastin, keratin and charged nanoparticle materials, methods of making and using the materials and associated production-related devices. In one embodiment, a device for producing continuous electrochemically aligned strands, threads or fibers is disclosed. In a further embodiment, fabrication of compositionally and geometrically complex anatomical forms by 3D-electrochemical compaction of biomolecules is disclosed. In yet another embodiment, methods for fabricating patterned lattice structures, in particular having controlled pore size and morphology, and the lattice structures themselves are also disclosed.

While devices and methods for production of electrochemically produced materials are known, the art still has a need for additional production devices and methods as well as advanced materials, having different properties than those previously produced.

SUMMARY OF THE INVENTION

In view of the above, devices are disclosed herein for producing electrochemically aligned and compacted materials, that include, but are not limited to, strands, threads and fibers, which can be processed into further structures bounded only by the imagination of the user or fabricator. Electrochemically aligned and compacted materials are also disclosed and can be derived from molecules, nanoparticles and microparticles with ampholytic nature, such as collagen, elastin, keratin, and charged nanoparticle or microparticle materials. As used herein, the term "ampholytic nature" is defined as a substance that has different charges at different pH values.

Methods for production of the electrochemically produced materials are also described in detail.

Accordingly, in one embodiment of the present invention, a device is disclosed that can produce strands, threads or fibers of a desired length, utilizing a continuous production method. The production of such strands, threads or fibers in a relatively long length facilitates braiding or weaving the fibers into biotextiles.

In one embodiment, a horizontally-oriented electrochemical cell in the form of a horizontal rotating wheel is utilized.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

In this specification, all numbers disclosed herein designate a set value, individually, in one embodiment, regardless of whether the word "about" or "approximate" or the like is used in connection therewith. In addition, when the term such as "about" or "approximate" is used in conjunction with a value, the numerical range may also vary, for example by 1%, 2%, or 5%, or more in various other, independent, embodiments. All ranges set forth in the specification and claims not only include the end points of the ranges but also every conceivable number between the end points of the ranges.

For the avoidance of doubt, the compositions, devices and methods of the present invention encompass all possible combinations of the components, including various ranges of said components, disclosed herein. It is further noted that the term 'comprising' does not exclude the presence of other elements. However, it is also to be understood that a description on a product comprising certain components also discloses a product consisting of these components. Similarly, it is also to be understood that a description on a process comprising certain steps also discloses a process consisting of these steps.

As indicated herein, the invention relates to devices and methods for producing electrochemically aligned and/or compacted engineered materials, such as but not limited to, strands, threads, and fibers from one of more of molecules, nanoparticles and microparticles with ampholytic nature, such as collagen, elastin, keratin and charged nanoparticle materials, and the resulting engineered materials.

The term "fiber" as used herein refers to one or more of a single strand construction and a multi-filament or multi-strand construction. Multi-filament or multi-strand constructions can have monofilaments that are in physical contact at at least one location or can be at least partially bonded to each other. The term "fiber" is not limited to any specific profile or geometry.

Figure 1:
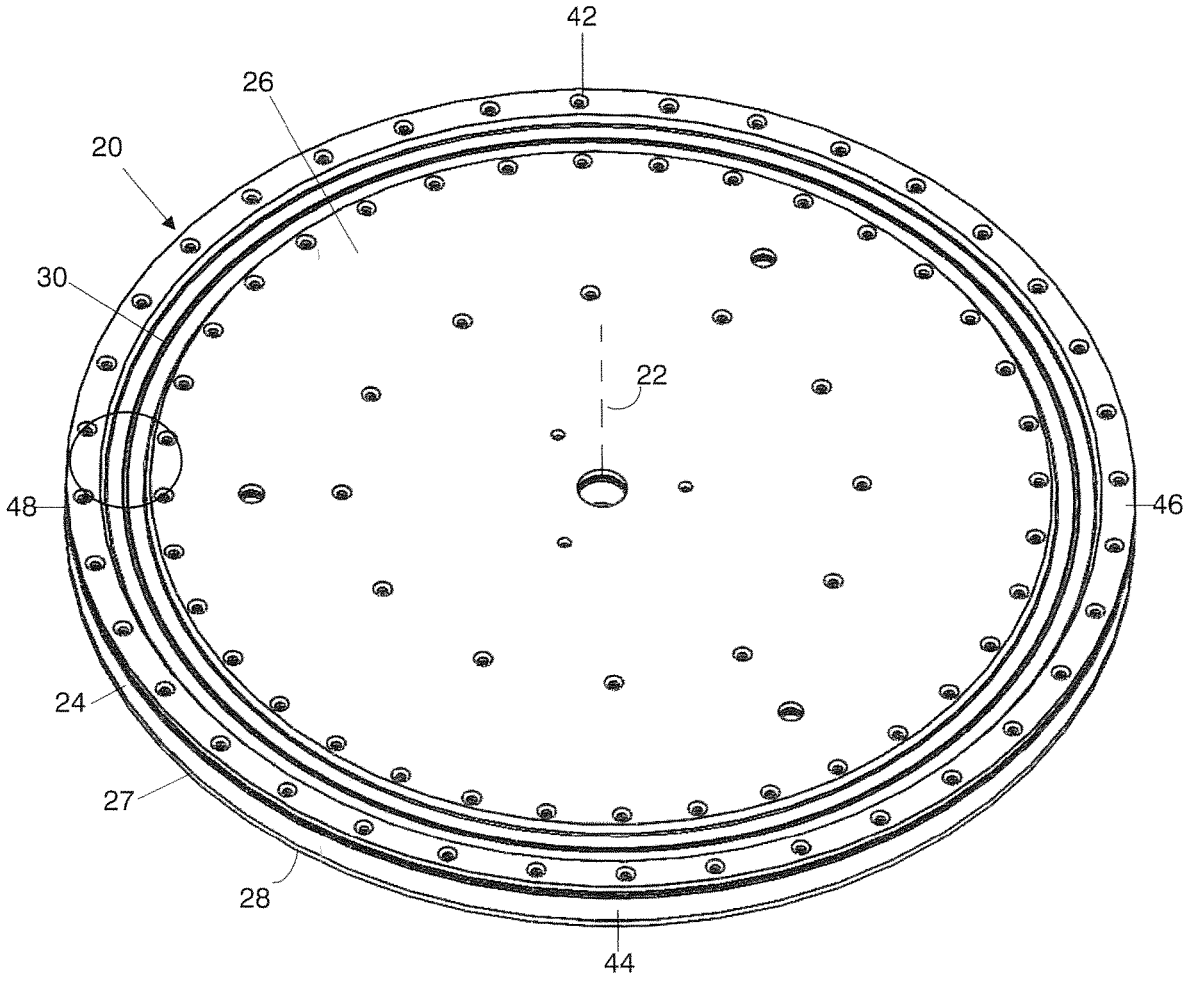
FIG. 1 is a slightly downward looking front, 3D view of one embodiment of a device including a horizontally-oriented electrochemical cell of the present invention.

Referring now to the drawings, wherein like parts or components are represented by like or identical reference numbers throughout the several views, FIG. 1 illustrates one embodiment of an electrode 20 of the device that is an electrochemical cell used to electronically align materials. The electrode is in the form of a wheel that is rotatable around a central rotational axis 22. Electrode 20 is situated in a plane that is substantially horizontal in one embodiment. That said, the orientation of the electrode can vary and be arranged generally at an angle from about 85° or 89° to about 95° or 91° in relation to a vertical axis, i.e. preferable central rotational axis 22, or around both in-plane axes of the wheel.

The electrode 20 includes an outer rim 24, which is circular in FIG. 1. Other configurations can be utilized, if desired. Electrode 20 also includes an upper surface 26 and a lower surface 28. Side surface 27 is located between upper surface 26 and lower surface 28.

Figure 2:
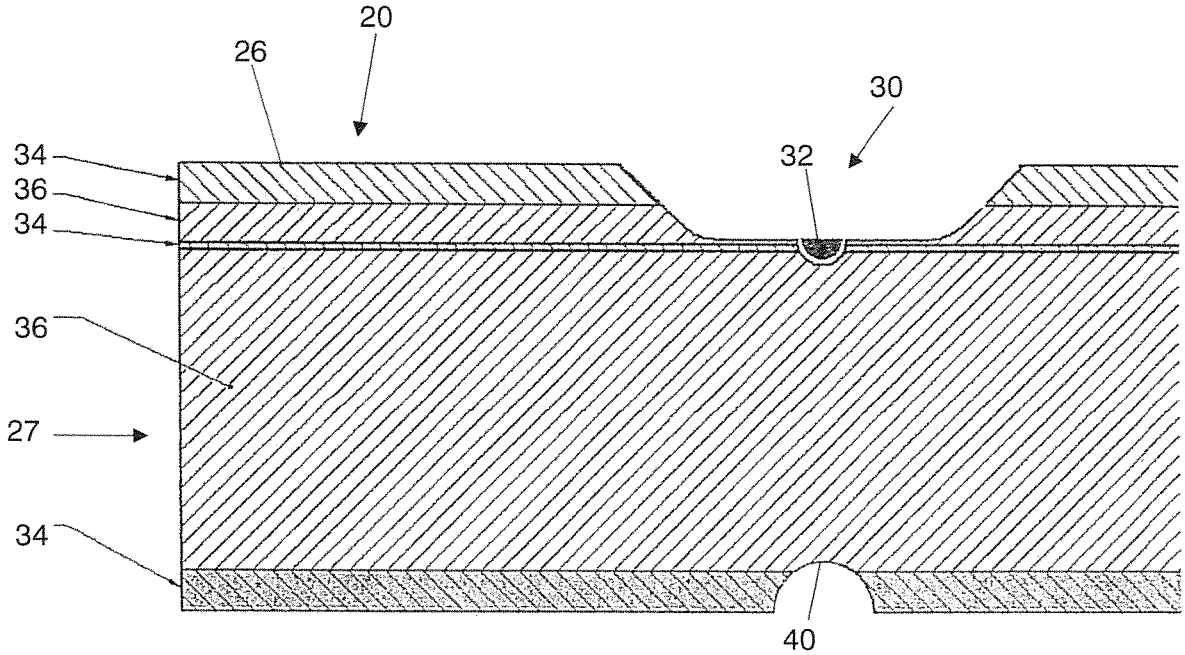
FIG. 2 is a detailed cross-sectional view of one embodiment of a horizontally-oriented electrochemical cell taken from the area marked with a circle in FIG. 1.

As illustrated in FIG. 2, electrode 20 includes a channel 30 on upper surface 26. Channel 30 has a groove that is a continuous track. The continuous track allows fabrication of various lengths of electrochemically aligned materials as desired. As long as a continuous supply of material-forming solution is supplied to the electrode, the length of the fiber produced therefrom is theoretically endless. The configuration also allows continuous reuse of the same electrode. For example, a material-forming solution can be applied to the electrode at one location on a groove of the channel, subsequently electrochemically processed into a strand like-which material is then removed from the portion of the electrode. By virtue of the rotation of the electrode, the portion from which the strand or fiber is removed is subsequently moved to a position where additional solution can be applied and the process repeated.

In one embodiment, the channel is in the shape of a circle and is located at a desired distance from central axis 22 that is preferably vertically or substantially vertically disposed. Channel 30 includes a groove 32. Groove 32 is also a continuous track. The depth and width of the groove can vary depending on factors such as the ability to accommodate a desired volumetric flow rate of the solution used to form the electrochemically aligned material. In various embodiments, the groove has a width from about 0.05 mm to about 10 mm and preferably from about 0.1 mm to about 5 mm, and a depth of from about 0.05 mm to about 10 mm.

Each side of the groove 32 includes a conductive layer 34 which is located below an insulating layer 36 in FIG. 2. An insulating layer 36 is also located below conductive layer 34 and forms a base, bottom or lower portion of groove 32 of channel 30. A second conductive layer 34 is located below insulating layer 36, such as illustrated in FIG. 2. An additional conductive layer 34 is present on an upper surface of the electrode 20 in one embodiment. Each of the layers of the electrode 20 can be fixed to each other mechanically and/or chemically, such as through the use of, but not limited to, features, adhesives and the like. The features are non-conductive in one embodiment. Suitable conductive materials include, but are not limited to, stainless steel, gold, aluminum, platinum, graphite and like and suitable insulating materials include polycarbonate, polyethylene, polytetrafluoroethylene such as Teflon® and ceramic materials. For the avoidance of doubt, combinations of materials can be utilized.

The conductive layers on either side of groove 32 of channel 30 are separated from each other and serve as an anode and cathode of the electrochemical cell. The conductive layer 34 that is part of the groove 32 and bottom, second conductive layer 34 are electrically connected to each other by wires, pins, rods or conductive paste. A suitable voltage is supplied by a suitable power source to lower conductive layer 34 by any suitable elements such as connecting brushes or springs on either side of a lower channel 40. Current is transferred from the lower conductive layer 34 to one of the conductive layers on either side of the groove 32, through the solution in the groove and to the opposite conductive layer. Applied voltage generally ranges from about 1 volt to about 200 volts and preferably from about 12 volts to about 60 volts. The voltage is preferably direct current (DC) voltage.

As the electrode 20 is rotated around the central axis 22, which is vertically oriented, a desired solution such as a collagen solution is deposited into the groove 32, where it comes into contact with the upper conductive layer 34, closing and completing a circuit. The current passes through the solution, electrochemically aligning the solution deposited into the channel.

The horizontally disposed rotating electrode 20 should have a surface finish that prevents damage to the electrochemically aligned material formed during fabrication. A draft, chamfer, or fillet can be formed/cut on the side walls of channel 32, for the ease of thread removal. Additionally, the electrode should be resistant to corrosion that electrochemical processes can induce. Further, it should be made as large as possible for ease and speed of operation.

The electrochemically aligned material, e.g. in the form of a strand or fiber, in the groove is collected, such as on a spool whose rotational speed is synchronized with the rotation of electrode 20.

Figure 3:
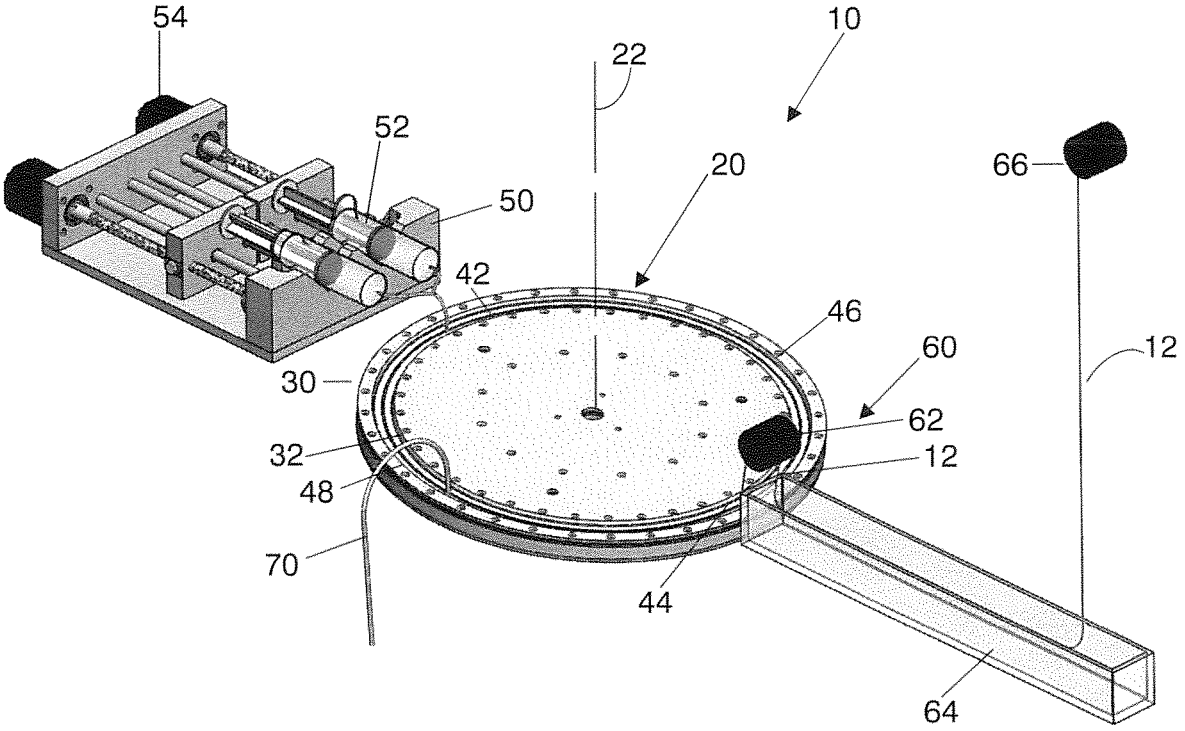
FIG. 3 is a perspective view of a further embodiment of a device including a horizontally-oriented electrochemical cell of the present invention.

FIG. 3 illustrates a further embodiment of the device 10 for producing electrochemically aligned materials. Device 10 includes a solution reservoir system 50 which houses a composition, preferably in the form of a solution which, after processing, forms the electrochemically aligned material. The solution reservoir system 50 generally includes a solution reservoir 52 in one embodiment which contains a desired volume of solution to be processed. A pump 54 controls the flow rate of the solution in solution reservoir 52 to electrode 20. The reservoir 52 includes or is otherwise connected to an outlet that is positioned to release the solution into groove 32 of electrode 20. In a preferred embodiment, the outlet is positioned over the groove 32 of the channel 30 such that the solution drains or is otherwise deposited into the groove 32 when expelled from the solution reservoir system 50. The volume of the reservoir 52 is sufficient such that a desired length of electrochemically aligned material is formed by the device.

While the solution reservoir system 50 illustrated in FIG. 3 is illustrated having a relatively small volume, it is to be understood that the solution reservoir can be as large as desired. The reservoir 52 may not even be situated directly adjacent the electrode 20 as the solution may be pumped from a remote location via pump 54.

It should further be clear as illustrated in FIG. 3 that the electrode 20 can be rotated such that each portion of the groove 32 can be placed under outlet 41. When actuated, electrode 20 rotates in either a clockwise or counterclockwise direction. As the electrode rotates, individual portions of the groove are also rotated such that at one point during a complete rotation they are underneath or below outlet 41. The solution can thus be applied to the entire length of the track of groove 32 during a complete rotation, if desired.

Collector 60 as shown in FIG. 3 is located downstream from solution reservoir system 50 and electrode 20 and is used to remove and/or receive the formed material from electrode 20. An operator picks up the end of the thread and places it on the collector 60. The newly produced thread is then pulled continuously by the thread that has already been collected. The material is first removed from the electrode by an operator who picks up the end of the strand. In one embodiment, extraction spool 62 of collector 60 receives electrochemically aligned material 12 from the electrode 20 and transfers the same to a bath 64 for further treatment of material 12. After processing in bath 64, the material 12 is transferred to collection spool 66.

The solution is added to groove 32 at a "12 o'clock" position 42 of the electrode 20, and can be collected at the 6 o'clock position 44, although anywhere from 3 to 9 o'clock position 46, 48 respectively is acceptable. All actuators (such as stepper or servo motors) are controlled by a central device "controller" which may utilize closed loop or open loop control. The electrode 20 may be connected to the actuator by a suitable gear train.

Once the electrochemically aligned material is collected, the electrode groove 32 is cleaned by a cleaning device 70, for example a vacuum tube, or a mechanical device such as a brush, swab or the like.

The solution is applied from a solution source such as a solution reservoir system 50 including for example a multichannel pump 54. The controller keeps track of the amounts of solution left in each reservoir and warns the operator to change or refill the reservoir when necessary. A mechanical pump, such as a peristaltic pump, hydraulic, or pneumatic dispenser may be used as well. The flow can be driven by gravity as another alternative.

The pump 54 of the pump system desirably provides uniform flow. Typically, peristaltic pumps do not provide uniform flow and their output is "pulsed" due to the motion of the roller along a tube. Peristaltic pumps can be modified to be utilized in the device of the invention by adjusting a motor speed of the pump to reduce fluctuations in the output flow rate.

The process is automated by overseeing and automatically adjusting production related parameters. One such variable is automatic break detection wherein the output of a camera or a motion sensor directed at the thread of electrochemically aligned material that is being recovered is connected to the controller that processes the video feed from the camera and warns the user if the thread breaks. The device 10 stops if the operator does not acknowledge the error in a preset amount of time such as 10 seconds. Image processing is also used to maintain a constant tension on the thread by determining the angle of separation of the thread being recovered; the controller slows down the spool collection speed if the tension is too high or increases the spool collection speed if the collection is too slack. Continuous feed of solution by pump 54 is also synchronized by the controller. The user input specifies the volume of solution required per unit length of thread and the length of thread produced per time (meters/minute; feet/minute, etc.). The controller adjusts the speeds of the actuators as necessary. The controller also keeps track of the length of thread produced since the beginning of a batch, or since the last breakage, or since the counter was reset by the user.

Figure 4:
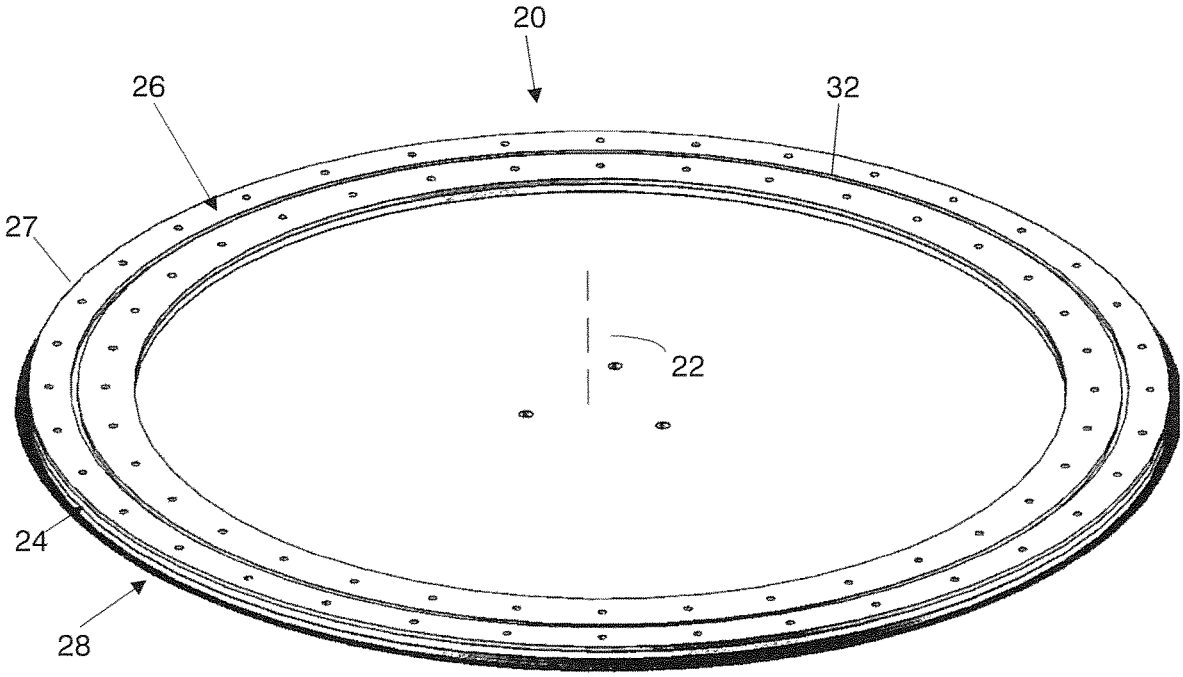
FIG. 4 is a slightly downward looking, front, 3-D view of a further embodiment of a device including a horizontally-oriented electrochemical cell of the present invention.
Figure 5:
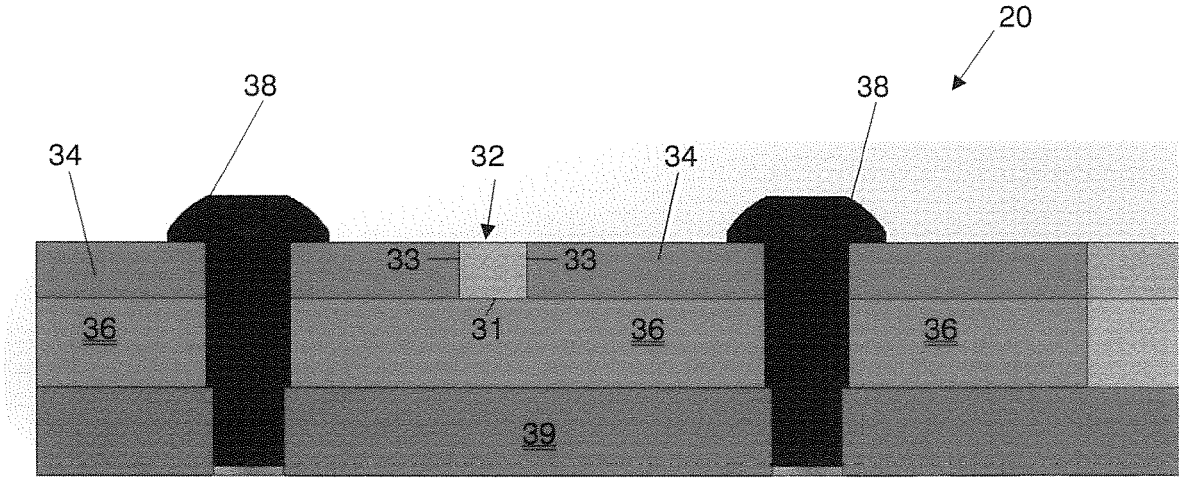
FIG. 5 is a partial cross-sectional view of the embodiment of the device illustrated in FIG. 4.

FIGS. 4 and 5 illustrate a further embodiment of an electrode 20 for device 10 of the present invention. Similar to FIG. 1, the electrode 20 also has a rotational axis 22. Electrode 20 can be oriented and arranged as set forth above with respect to the electrode described in FIG. 1. Electrode 20 includes an outer rim 24, which is also circular in FIG. 4. Side surface 27 is located between upper surface 26 and lower surface 28. A groove 32 is present on the upper surface 26 and has a width and depth as described hereinabove. The particular groove 32 illustrated in FIG. 5 is relatively rectangular in cross-section. That said, the cross-section of the groove 32 can vary and can have side walls 33 and a base 31 that are straight, curved, angled, or have any other desired shape so long as the groove is able to contain a solution.

Each side 33 of groove 32 includes a conductive layer 34. In the embodiment illustrated, conductive layer 34 forms a part of a top layer of electrode 20. An insulating layer 36 is located below conductive layer 34. A base layer 39, preferably conductive, is present in the embodiment illustrated in FIGS. 4 and 5. Aluminum is utilized as the base 39 in one embodiment. Conductive layer 34, insulating layer 36 and base layer 39 are connected in one embodiment by a non-conductive fastener 38.

In one embodiment, one pole of the electrode, i.e. one side 33 of conductive layer 34, is connected to conductive base layer 39 in one embodiment utilizing a spring or other suitable contact. A further current transfer device, such as a metal screw, is adapted to transfer current to the inner pole of the electrode, the right conductive layer illustrated in FIG. 5, for example. The solution in the grove completes the circuit between the poles of the electrode, such as described herein.

The rotating wheel electrode of the present invention is easy to manufacture and maintain. Individual layers can be easily replaced or repaired due to the construction of the device.

The prior art included vertically rotating wheel electrodes which may result in the loss of collagen stock solution in the form of liquid that ran off under the effect of gravity. Up to 30% of the collagen may be lost during production which would require recollection and recycling, reducing the efficiency of the process. The horizontally rotating electrode system enables close to 100% efficient collection of collagen threads. The resulting material or threads from the device including the horizontally oriented electrode are as compacted, as aligned and as strong as the threads made by the prior vertically rotating electrode device. Reduced runoff also allows using a lower voltage range for electrocompaction, such as 5-20V. The device of the present invention also has the advantage of being able to work with a relatively dilute solution and provides excellent compaction strength.

The aligned material, generally in the form of a thread, is collected off the rotating electrode using a collector 60, including a recovery or extraction spool 62 that separates the thread from the channel and directs the thread into a treatment solution in bath 64. The speed of the spool 62 is also set by the controller and is synchronized with the speed of the rest of the actuators. The treatment solution is typically isopropanol, but can be pure water, PBS, ethanol, isopropanol, acetone, chloroform or a mixture of those. The aligned material thread is kept in the treatment solution typically for 5-10 minutes, but this can vary from as little as a second, to as much as an hour in some embodiments.

In one embodiment, the end of the thread is recovered from the treatment solution by another spool 66 that is placed above the treatment bath. The spool is placed about a meter (as low as a few inches, no higher than a few meters in other embodiments) above the treatment bath so that the treatment solution deposited on the thread evaporates by the time the thread is being spooled. Fans or air blowers may assist the drying process.

In a further embodiment, the electrochemically aligned materials are collected in a treatment bath. The bath is a round, leak-proof container with a protrusion in the center, creating a toroidal concave area for the collected material to reside. The bath rotates about a central vertical axis that is substantially parallel with the rotational axis 22, collecting the electrochemically aligned material in the toroidal area. The shape of the bath allows storing long threads without entanglement. Once a batch is finished, the thread is collected from the bath by spinning the bath in "reverse.

Although the method described above is for the treatment of the aligned materials such as strands or threads in a continuous manner, a batch processing approach may also be used, that is: the aligned material will be recovered from the electrode by the recovery spool and directed into the treatment solution where it will be collected, either on another spool or without any guidance. When the desired length of material is produced, the end of the material will be taken out of the solution and placed on a spool placed above the solution that will collect the material at a rate that will allow it to dry.

In accordance with the patent statutes, the best mode and preferred embodiment have been set forth; the scope of the invention is not limited thereto, but rather by the scope of the attached claims.

What is claimed is:

1. A device for producing an electrochemically aligned strand, comprising:

a pump system including a) a pump, b) a solution reservoir for a solution comprising one or more of electrochemically alignable molecules, nanoparticles or microparticles with ampholytic nature, and c) an outlet;

a substantially horizontally disposed electrode having a groove on an upper surface of the electrode, wherein the electrode is rotatable around a substantially vertical axis, wherein the groove extends completely around the axis at a distance therefrom, the groove having a conductive layer on each side of the groove, wherein the outlet is positioned above the groove such that the solution is appliable to a location in the groove, wherein the groove is rotatable around the axis, wherein the electrochemically aligned strand is formable in the groove upon transmission of an electric current to the conductive layer; and a collection device positioned relative to the electrode such that the electrochemically aligned strand formed on the electrode is collected by the collection device.

2. The device according to claim 1, wherein the electrode is rotatable such that each portion of the groove can be located at a position below the outlet.

3. The device according to claim 2, wherein the electrode is in the shape of a disk having multiple stacked layers including the conductive layer, wherein the conductive layer is disposed on top of a non-conductive layer and wherein the groove is a circular track.

4. The device according to claim 3, wherein a base of the groove is formed at least in part with the non-conductive layer.

5. The device according to claim 3, wherein the conductive layer forms a top layer of the electrode.

6. The device according to claim 1, wherein rotation of the electrode is actuated by a motor that is present and operatively connected to the electrode.

7. The device according to claim 1, wherein the electric current is supplied to the conductive layer on one side of the groove.

8. The device according to claim 7, wherein the device includes a microprocessor, wherein one or more of a flow rate from the solution reservoir, a rotational speed of the collection spool and a rotational speed of the electrode are differentially controlled by the microprocessor.

9. The device according to claim 1, wherein the electrode is arranged at an angle from about 85° to about 95° in relation to the vertical axis.

10. The device according to claim 9, wherein the electrode is arranged at an angle from about 89° to about 91° in relation to the vertical axis.

11. The device according to claim 3, wherein the stacked layers are connected utilizing a nonconductive fastener.

12. The device according to claim 1, wherein the groove has a width from about 0.05 mm to about 10 mm and a depth of from about 0.05 mm to about 10 mm.

13. The device according to claim 12, wherein the groove has a width from about 0.1 mm to about 5 mm.

14. The device according to claim 12, wherein the electrode is rotatable such that each portion of the groove can be located at a position below the outlet.

15. The device according to claim 14, wherein the electrode is in the shape of a disk having multiple stacked layers including the conductive layer, wherein the conductive layer is disposed on top of a non-conductive layer and wherein the groove is a circular track.

16. The device according to claim 15, wherein a base of the groove is formed at least in part with the non-conductive layer.

17. The device according to claim 16, wherein the conductive layer forms a top layer of the electrode.

18. The device according to claim 17, wherein rotation of the electrode is actuated by a motor that is present and operatively connected to the electrode.

19. The device according to claim 18, wherein the electric current is supplied to the conductive layer on one side of the groove.

20. A method for producing an electrochemically aligned strand, comprising the steps of:

obtaining a device according to claim 1;

filling the solution reservoir with a quantity of the solution comprising one or more electrochemically alignable molecules, nanoparticles or microparticles with ampholytic nature;

applying the solution to a portion of the electrode;

applying an electric current to the solution during rotation of the electrode to induce electrochemical alignment; and transferring the electrochemically aligned strand formed on the electrode from the solution to the collection device.

* * * * *